US005195253A

United States Patent [19]

Poumey et al.

[11] Patent Number: 5,195,253

[45] Date of Patent: Mar. 23, 1993

[54] CORDLESS ELECTRIC HAIR-DRYER

[75] Inventors: Michel Poumey, Ecully; Christian Latore, Vienne, both of France

[73] Assignee: Cableco and Beaba, France

[21] Appl. No.: 713,305

[22] Filed: Jun. 11, 1991

[30] Foreign Application Priority Data

Jun. 12, 1990 [FR] France ..... 90 07549

[51] Int. Cl.[5] ..... A24D 20/10

[52] U.S. Cl. ..... 34/97; 392/382; 392/385

[58] Field of Search ..... 34/97, 98; 392/380, 392/382, 384, 385

[56] References Cited

U.S. PATENT DOCUMENTS 3,938,018 7/1976 Dahl .
4,397,055 1/1983 Cuchiara .
4,757,183 7/1988 Karey et al. ..... 34/97 X
4,767,914 8/1988 Glucksman ..... 34/97 X

FOREIGN PATENT DOCUMENTS 0176441 4/1986 European Pat. Off. .
0203437 5/1986 European Pat. Off. .
3429319 2/1986 Fed. Rep. of Germany .
2183154 6/1987 United Kingdom .

*Primary Examiner*—Stephen M. Hepperle
*Attorney, Agent, or Firm*—Wall and Roehrig

[57] ABSTRACT

A cordless electric hair dryer and stand are provided in which the portable hair dryer unit has a rechargeable battery and a thermal heat reservoir. The fan blows ambient air over the thermal reservoir in heat exchange relationship to expel hot air from the dryer when in use. The stand has an electrical circuit inductivley coupled through a coil in the base of the stand to a coil in the rear of the housing of the dryer which provides power to charge the rechargeable battery in the handle of the dryer and to heat the thermal storage medium in the dryer. The heating is accomplished by resistors mounted in heat exchange relationship with the thermal reservoir material. The rechargeable battery is used only to run the fan during drying operation of the portable unit.

4 Claims, 2 Drawing Sheets

CORDLESS ELECTRIC HAIR-DRYER

The invention relates to a cordless electric hair-drier. By "cordless hair-drier" is meant a hair-drier which has no attachment cord to the main supply, but which is nevertheless able to generate a directed hot air flow.

BACKGROUND OF THE INVENTION

The use of electrical appliances, especially domestic appliances, without an attachment line to the main supply has been known for some time now and is tending to further increase daily on account of its practical aspects. However, this use is generally limited to the occasional operation of a number of appliances equipped with an electric motor, such as table sweepers, fans, mixers, electric screw-drivers etc. These appliances are generally equipped with an electric battery which may or may not be rechargeable and whose capacity, given an acceptable size, is sufficient to ensure the corresponding periodic use of the appliances. In the context of rechargeable batteries, these appliances are equipped with a stand connected to the main electricity supply and have electrical contacts intended to cooperate with corresponding electrical contacts provided on the actual appliance.

Although it is true that these appliances function correctly within the context of their application, they nevertheless have the double disadvantage that, when the power needed for the appliance increases, they require, on the one hand, electric batteries of large dimensions, thereby increasing the weight and the space taken up, and, on the other hand, electrical contacts which are of good quality and durable over the course of time.

In the specific context of cordless hair-driers, appliances have been proposed in which the thermal source was ensured either by catalysis or by means of gas burners. In this case, the electricity source supplies only the fan intended to pulsate the air at the thermal source, with a view to creating the hot air flow leaving the hair-drier. However, this type of hair-drier has the disadvantage of requiring a periodic replacement of the cartridges and, moreover, the addition of piezoelectric devices, or similar, able to ensure the lighting of the gas. Furthermore, they are not without danger in the event of being dropped, given the risk of gas escaping and of its instantaneously combusting. Hair-driers have also been proposed in which the thermal source conventionally consists of electrical resistors, and whose supply is provided by means of rechargeable accumulators when the hair-drier is positioned on a stand, itself connected to the main electricity supply (see, for example, DE-A-3,429,319). This type of appliance proves to be of very limited use in terms of time, due to the fact that the charge of the accumulators for feeding said electrical resistors is very quickly exhausted.

SUMMARY OF THE INVENTION

The invention aims to overcome these various disadvantages. It proposes a hair-drier using a thermal store as the thermal source, and an electrical store by means of rechargeable batteries for activating a fan able to generate the flow of air.

It therefore proposes a cordless electric hair-drier consisting of a stand, which is connected via a plug to the main electricity supply, and of an actual portable hair-drier which can be placed in said stand, characterized in that the actual hair-drier comprises :

- a thermal reserve, the heating of which is effected outside with the periods of use, when it is positioned on its stand,
- an electrical energy accumulator, recharged when the hair-drier is positioned on its stand, this energy being used during operation only for carrying towards the front face of said hair-drier the heat energy stored in the thermal reserve.

In other words, the invention proposes a hair-drier of such a design that the accumulation of heat is effected only during the periods in which said hair-drier is not in use, the delivery of the heat energy thus stored requiring only a conventional means, typically a fan, which consumes little energy, and therefore not involving accumulators of large capacity, but consequently ones taking up little space.

According to the invention, the stand comprises a so-called "primary" electrical circuit generating high-frequency energy at the level of an inductor formed in one of its faces intended to face the rear face of the actual hair-drier when the latter is placed in said stand, the actual hair-drier comprising :

- a secondary electrical circuit supplied with electrical energy by electromagnetic induction via the primary electrical circuit of the stand when the hair-drier is placed in the latter, said secondary circuit comprising an induction coil provided at the level of the rear face of the hair-drier and mounted in parallel with a capacitor in order to form a block oscillating circuit of slightly greater resonance frequency than the resonance frequency of the primary circuit, the
- secondary circuit supplying with electricity one or more electrical resistors, and additionally comprising, in parallel, an accumulator provided with a rectifying device intended to supply a motor with electrical energy ;
- a closed reservoir for accumulation and exchange of heat, containing a heat-conducting substance heated by means of said electrical resistors ;
- and a fan activated by said electric motor and intended to pulsate ambient air at said reservoir for accumulation and exchange of heat, with a view to generating a hot air flow by means of thermal exchange between the ambient air and said reservoir.

According to one important characteristic of the invention, the heat-conducting substance is heated only when the secondary electrical circuit is supplied with electricity, that is to say when the hair-drier is placed in its stand.

According to another characteristic of the invention, the reservoir for accumulation and exchange of heat comprises fins extending radially away from the latter and capable of optimising the thermal exchange between the ambient air pulsated by the fan and said heat source.

The secondary electrical circuit additionally comprises a thermostat whose probe is situated on the reservoir for accumulation and exchange of heat, which thermostat is intended to monitor the temperature of the heat-conducting substance when said substance is being heated, that is to say when the hair-drier is in place on its stand.

The stand is of generally circular shape, the cross-section of which is U-shaped, and the base receives the inductor of the primary electrical circuit and comes into contact with the rear face of the actual hair-drier when the latter is placed on the stand.

BRIEF DESCRIPTION OF THE DRAWINGS

The manner in which the invention can be achieved and the advantages which derive therefrom will emerge more clearly from the exemplary embodiment given below by way of non-limiting example, with reference to the attached figures.

DETAILED DESCRIPTION OF THE PREFERRED EMBODIMENT

Figure 3:
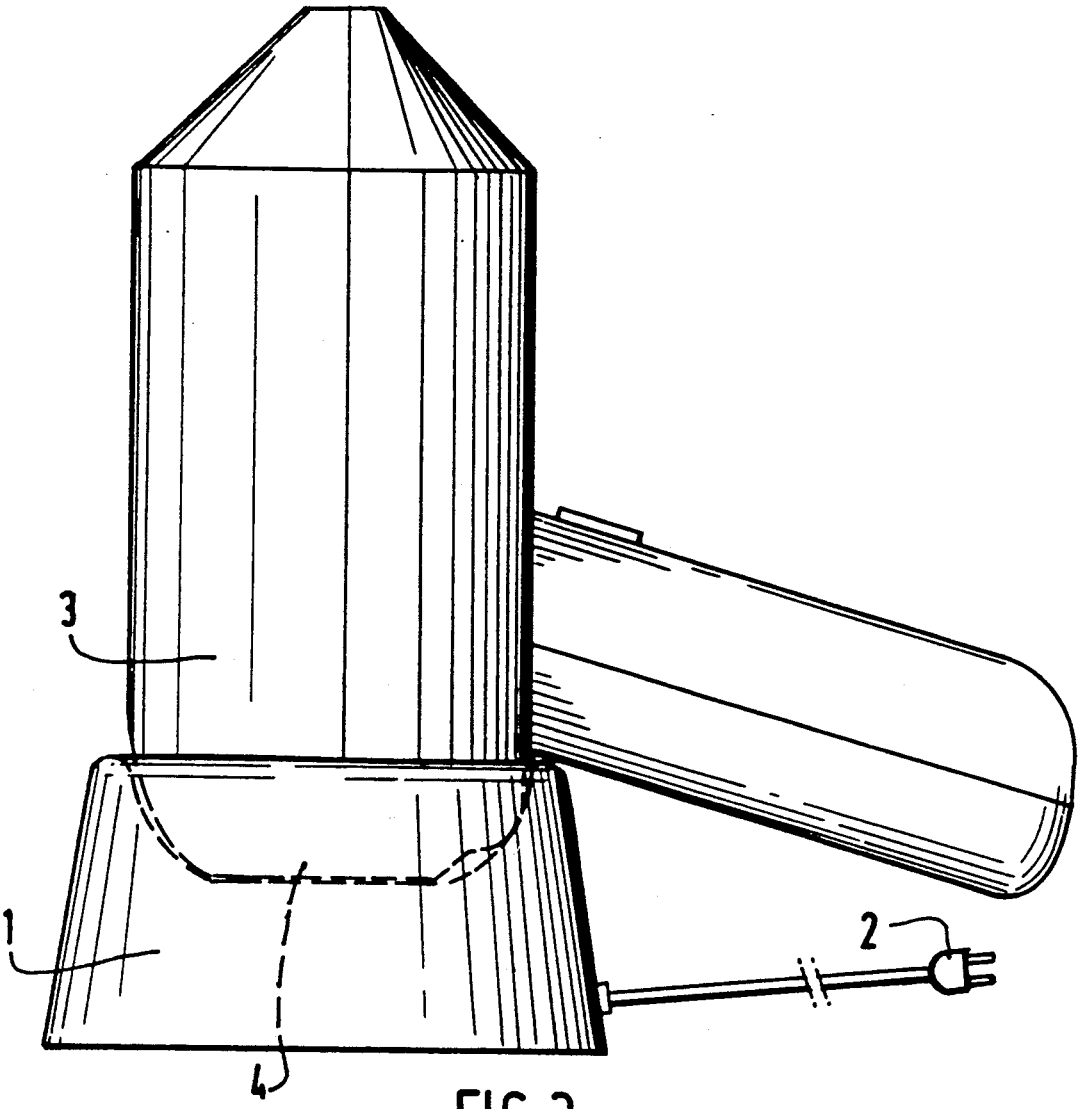
FIG. 3 is a diagrammatic representation of the hair-drier in place on its stand.

According to the invention, and as can be seen in FIG. 3, the hair-drier consists of two elements, namely the stand (1) connected to the main electricity supply via a plug (2), and the actual hair-drier (3), also called "pistol part". The latter is placed in the stand (1) when not in use, the stand being of appropriate shape. The stand is typically circular and has a U-shaped cross-section whose base (8) receives the rear face (4) of the hair-drier (3).

Figure 4:
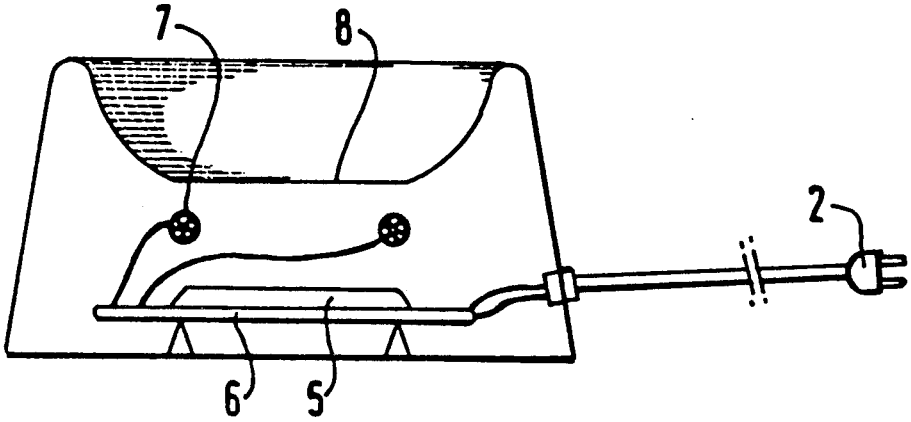
FIG. 4 is a diagrammatic cross-section of the stand.

As shown in FIG. 4, the stand comprises a primary electrical circuit consisting basically of a high-frequency energy generator (5) connected to a printed circuit (6), the latter being itself supplied with electricity from the main supply via the plug (2), and this without any transformer. Since high-frequency energy generators are in wide use, the generator (5) will not be described further. In a known manner it discharges an alternating current at high frequency into an induction coil (7) of circular shape forming, together with a capacitor incorporated in the generator (5), an oscillating circuit of the series or parallel type. The operating frequency of this assembly corresponds to the resonance frequency of the oscillating circuit. The frequency used is typically of the order of several tens of kilohertz (kHz). The efficiency of the generator thus designed is of very high quality, greater than 90%, which limits the heating inside the stand. In this way, the latter can advantageously be made of plastic, for example of acrylonitrile-butadiene-styrene (ABS), or even of polycarbonate, and without any opening, which fact confers upon it a high degree of safety from the point of view of electrical insulation. In addition, since the induction coil (7) does not comprise many turns, in contrast to a transformer operating at the main frequency, the electrical insulation between the turns can be greater without substantially increasing the size of the inductor, thereby avoiding the possibilities of short-circuiting between the turns and, thus, the risks of fire.

According to one characteristic of the invention, the induction coil (7) is situated just below the base (8) of the U constituting the stand (1).

The high-frequency current circulating in the induction coil (7) creates, in a known manner, a variable electromagnetic field of the same frequency, which crosses, without absorption, the plastic walls of the stand and, in particular, the wall immediately adjacent to it and corresponding to the base (8) of the U.

The actual hair-drier or pistol part (3) according to the invention is also made of plastic material, such as ABS or polycarbonate. It basically comprises a reservoir (9) for accumulation and exchange of heat and containing a heat-conducting substance. The reservoir (9) also accommodates on the inside one or more electrical resistors (10). The heat-conducting substance can be liquid or solid at ambient temperature. The electrical resistors (10) bring this substance, during the period of recharging, that is to say of non-use, to a maximum temperature controlled by means of a thermostat (11) whose probe is situated against the reservoir (9). The maximum temperature is typically in the region of 100° C. In fact, depending on the nature of the heat-conducting substance contained in the reservoir (9), the heating process generates either a simple rise in the temperature of said substance, the latter remaining in the physical phase in which it is present, or a change of phase state is induced by absorption of the latent energy of change of state. Thus, during the restoration of the heat by the heat-conducting substance, either use is made of the heat corresponding to the cooling of the substance in the framework of a conservation of the phase, or use is made, on the one hand, of the cooling of the two successive phases of the substance and, on the other hand, of the latent heat of the change of state, such as gas-liquid or liquid-solid transition.

It should be noted that the change of state makes it possible, for a given reservoir volume, to accumulate more heat and, therefore, to restore more of the same when the need arises. The reservoir (9) can in fact be of reduced size.

The reservoir (9) has the role of heat exchanger during the phase of use of the pistol part (3). It is therefore made of a heat-conducting metal, for example aluminium, and comprises on its periphery, for the purpose of a better thermal exchange, cooling fins (12) extending radially away from the reservoir, thereby increasing the surface of exchange with the air pulsated as described below.

The internal volume of the reservoir (9) is typically in the region of 70 to 100 milliliters, and this for a hair-drier more specifically intended for babies and young children. It is possible in the same way to provide a reservoir having a capacity of between 200 and 400 milliliters, without thereby increasing considerably the size of the hair-drier.

The pistol part (3) additionally comprises a motor (13) actuating a fan (14). In a known manner, the latter is intended to draw in the ambient air outside the pistol part (3), and this by way of air admissions provided on its rear face (15), and to pulsate this air towards the reservoir (9), the air being thus forced between the outer casing of the pistol part, made, as has already been stated, of plastic material, and the reservoir (9), permitting a thermal exchange between the air and the latter, with a view to generating a hot air flow emerging from the front face (16) of the pistol part (3). The motor (13) is activated electrically by means of rechargeable batteries (17) provided in the handle of the pistol part (3). The motor (13) is started by simply pressing on a push-button (18) provided on the front face of the handle of the pistol part (3). However, it would be quite conceivable to envisage the starting of the motor (13) of the fan (14) by any other means, such as a member for detecting the removal of the pistol part from the stand, and a time delay etc.

Figure 1:
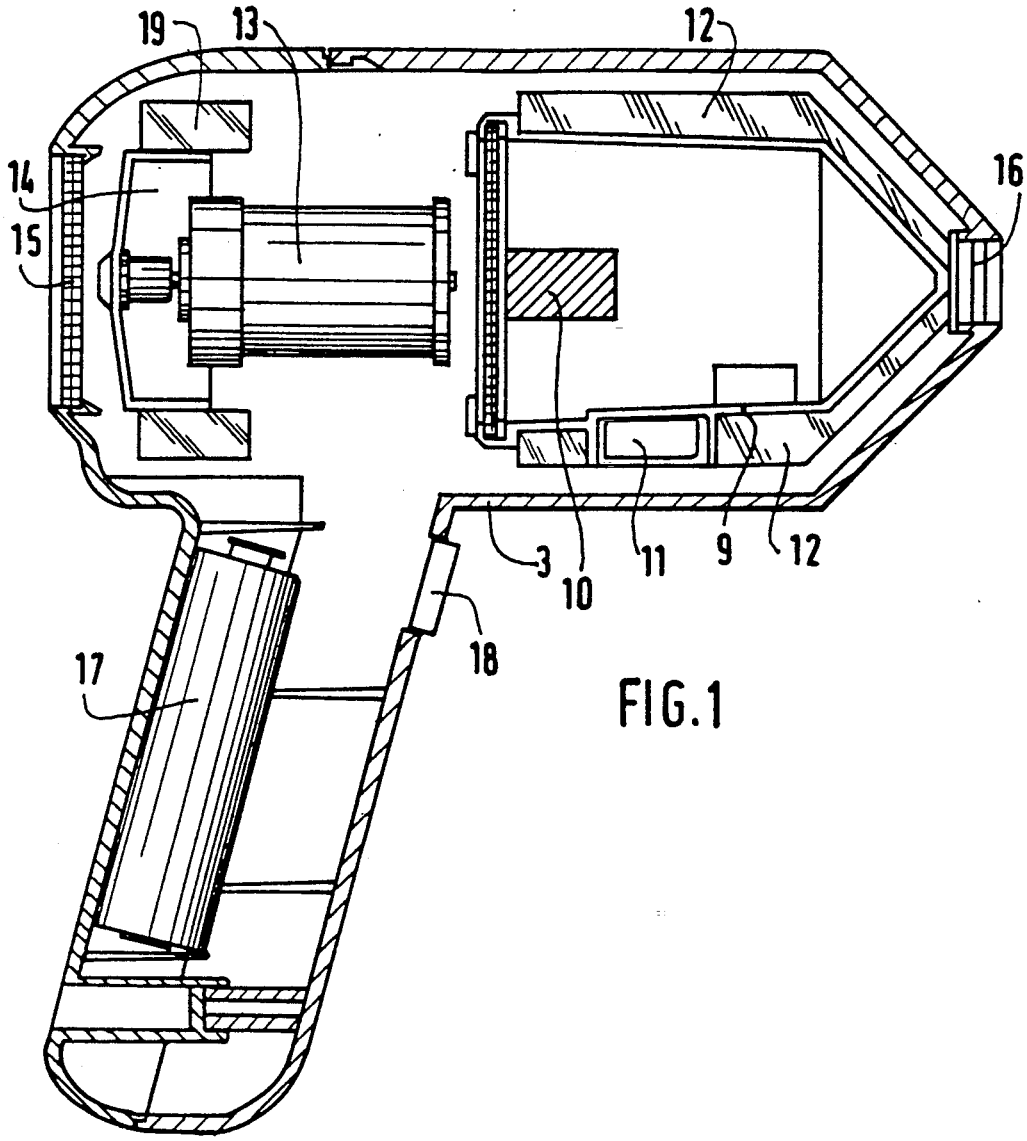
FIG. 1 is a longitudinal section of the actual hair-drier, also called pistol part, according to the invention.
Figure 2:
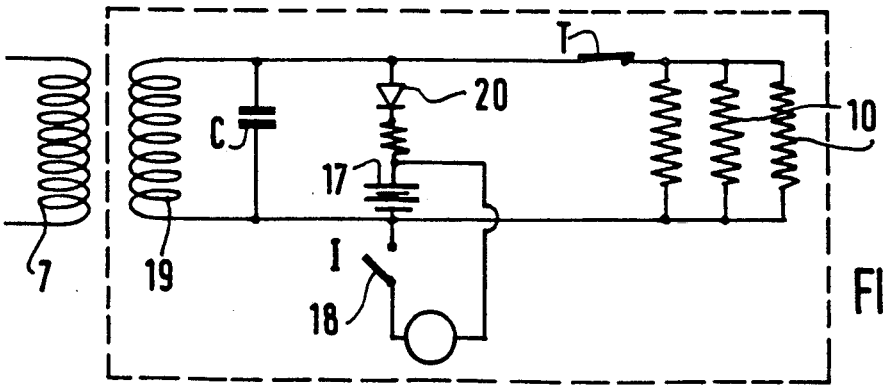
FIG. 2 is a diagrammatic representation of the secondary electrical circuit.

The supply of electrical energy to the resistors (10) and the recharging of the batteries (17) of the pistol part (3) will now be described in detail. A basic electrics diagram corresponding to the secondary electrical circuit of the pistol part (3) has been shown in FIG. 2. This circuit basically comprises a sensing or induction coil (19) of circular shape disposed parallel to and in the immediate vicinity of the rear face (15) of the pistol part (3). This pick-up coil (19) is of the same type as that of the stand (i). It is mounted in parallel with a capacitor C in such a way as to form a block circuit or oscillating circuit, the resonance frequency of which is slightly greater than that of the functioning of the circuit. This circuit constitutes a source of alternating voltage of a frequency equal to that of the generating circuit and functions in accordance with the principle of electromagnetic induction : the electromagnetic field emitted by the inductor (7) is picked up at a distance by the induction coil (19) and transforms this field into electromotive force. In fact, the distance between the inductor (7) and the induction coil (19) can be several centimeters, which provides a relatively high degree of insulation between the primary generating circuit contained in the stand (1) and the secondary block circuit contained in the pistol part (3). Consequently, there is an absence of electrical contact between these two circuits.

The secondary electrical circuit first supplies in parallel the electrical resistors (10) used to heat the heat-conducting substance contained in the closed reservoir (9) during the periods of non use.

In addition, it supplies, via a diode (20) acting as a rectifying device, the battery (17) feeding the motor (13) of the fan (14), for the purpose of its recharging. The battery is in fact charged during the periods of non-use.

In the period of non-use, the pistol part (3) rests on the stand (1) and, more specifically, rests via its rear face (15) situated in the vicinity of the upper face (8) of the stand (1). Thus, these two faces and, consequently, the inductor (7) and the induction coil (19) are situated parallel to one another. The inductor (7) and the induction coil (19) are situated at a distance in the region of one to two centimeters. Since the stand is connected to the main electricity supply, an electromagnetic field is therefore created resulting, on the one hand, in the charging of the battery (17) and, on the other hand, in the heating of the heat-conducting substance contained in the closed reservoir (9). On account of the presence of the thermostat (11), there is no risk of excessive heating of the heat-conducting substance, whatever the duration of the period of non-use. Correspondingly, on account of the presence of the diode (20), once the battery (17) is recharged there is no risk of it discharging into the secondary electrical circuit.

In the period of use, the pistol part (3) is therefore no longer placed in the stand (1), and the user actuates a switch (18) intended to start the fan (14), pulsating ambient air into contact with the reservoir (9), in order to generate a hot air flow at the front face (16). Correspondingly, the power absorbed by the stand when the pistol part is no longer placed therein is zero, on account of the fact that the primary circuit comprises a member for detecting the amplitude of the oscillations at the level of the inductor (7), able to open the primary circuit.

Typically, the heat accumulated during the period of recharging, for example lasting two hours, can thus be entirely restored in 10 minutes of operation. This result has the advantage of providing an appliance with a main power consumption which is ten or so times less than the instantaneous power restored. Thus, a hair-drier with a useful heat of 500 watts (W) will absorb only about 50 watts during the recharging period. This minimises the generator components contained in the stand, correspondingly reducing the cost price of such an appliance.

Thus, the use of the pistol part of the hair-drier is simple and completely safe, since the shutdown of the fan instantly stops the emission of hot air, without any risk of overheating inside the pistol part since the electrical resistors are no longer supplied 15 once the pistol part is not positioned in the stand. In addition, this hair-drier is very easy to handle on account of the absence of any electricity supply cord, and it also presents no danger to the user, even in the event of the penetration of water.

I claim:

1. An electric hair dryer assembly having a stand, adapted to be connected to a source of electrical power, for receiving a cordless hand-held hair dryer, the assembly comprising:

a portable hot air unit including a housing, said housing having a rear face and a front face;

a generally U-shaped receptacle formed in the stand for receiving the portion of said housing including said rear face;

a thermal reservoir means mounted within said housing adjacent said front face including a closed container having a heat conducting substance therein and a plurality of electrical resistors positioned in heat exchange relationship therewith and adapted to be activated during non use when mounted in the stand;

a rechargeable battery mounted in a portion of said housing;

fan means mounted in another portion of said housing for blowing air over said thermal reservoir means in heat exchange relationship with said closed container; and circuit means mounted in the stand and said housing for selectively energizing said rechargeable battery and electrical resistors only when said portable hot air unit is mounted in the stand and for operating said fan means to pulsate heated air out of the portable unit when the portable unit is removed from the stand, said circuit means including:

a primary electrical circuit mounted in the stand adjacent said U-shaped receptacle for generating a high frequency electromagnetic field; and a secondary electrical circuit mounted in said housing adjacent the rear face thereof having an oscillator circuit with a resonant frequency slightly greater than that of the high frequency field in the primary circuit so that when said portable hot air unit is positioned in the stand, said primary electrical circuit includes electrical energy into said secondary electrical circuit.

2. The apparatus of claim 1 wherein said primary and secondary electrical circuits include induction coil windings in said stand and dryer which, when said dryer is mounted in the stand, become the resonant circuit of a high frequency oscillator in the stand to inductively transfer electrical energy to said resistors to heat said thermal reservoir means and to recharge said battery.

3. The apparatus of claim 2 wherein said thermal reservoir means includes a plurality of fins extending radially away from said reservoir to optimize thermal exchange with the ambient air pulsated over said reservoir by said fan means.

4. The apparatus of claim 3 further including thermostat means mounted in contact with said reservoir and connected in said circuit means for controlling the temperature of said reservoir means during heating when said dryer is positioned in the stand.

* * * * *